United States Patent [19]

Hassell et al.

[11] Patent Number: 5,049,214

[45] Date of Patent: Sep. 17, 1991

[54] AEROSOL-FORMING PYROTECHONIC COMPOSITION

[75] Inventors: Cecil D. Hassell, Street, Md.; Lawrence A. Bickford, New Park, Pa.; Sandra D. Smith, Edgewood, Md.; Gartung Cheng, Edison, N.J.

[73] Assignee: The United States of America as represented by the Secretary of the Army, Washington, D.C.

[21] Appl. No.: 671,600

[22] Filed: Mar. 19, 1991

[51] Int. Cl.[5] ..... A01N 25/06; C06D 7/00; C06B 23/00

[52] U.S. Cl. ..... 149/109.4; 102/368; 424/40; 514/317; 546/218; 546/222

[58] Field of Search ..... 149/109.4, 19.6; 102/367, 368; 424/40; 514/317; 546/218, 222

[56] References Cited

U.S. PATENT DOCUMENTS

| | | | |
|---|---|---|---|
| 3,042,580 | 7/1962 | Jacobi et al. | 149/109.4 |
| 3,599,571 | 8/1971 | Richardson | 102/368 |
| 3,679,798 | 7/1972 | Culik et al. | 514/304 |
| 3,729,350 | 4/1973 | Gey | 149/109.4 |
| 3,903,094 | 9/1975 | Witten et al. | 546/239 |
| 3,929,530 | 12/1975 | Niles | 149/109.4 |
| 4,186,040 | 1/1980 | Aron et al. | 424/40 |
| 4,190,471 | 2/1980 | Flynn | 149/19.6 |
| 4,405,762 | 9/1983 | Earl et al. | 149/109.4 |
| 4,465,834 | 8/1984 | Baum et al. | 546/242 |
| 4,653,690 | 3/1987 | St. Armand | 149/19.6 |

*Primary Examiner*—Edward A. Miller

*Attorney, Agent, or Firm*—Anthony T. Lane; Edward Goldberg; Edward F. Costigan

[57] ABSTRACT

A mixture containing 3,3-bis(aziodomethyloxetane) and EA3834A for use, when ignited, as a physiologically activating agent against enemy personnel on the battlefield by friendly forces.

4 Claims, No Drawings

AEROSOL-FORMING PYROTECHONIC COMPOSITION

The invention described herein may be manufactured, used, and licensed by or for the Government for governmental purposes without the payment to us of any royalty thereon.

FIELD OF USE

This invention relates to an incapacitating composition which produces physiological affects on intended personnel, especially hostile soldiers in a battlefield environment.

BACKGROUND OF THE INVENTION

Due to the fact that pyrotechnics are dangerous, they must be handled with due care, particularly for safety sake. What complicates the problem is that the standard pyrotechnic composition contains a multitude of ingredients, such as fuel, an oxidizer, a coolant, a wetting agent, and a filler.

During manufacture, each of the aforesaid ingredients must be added to each other in a very rigid procedure, and in precise amounts. If this procedure is not carried out in the prescribed manner, there is danger of a hazardous condition which may come into play which could result in a conflagration, fire or even an explosion.

Further, if the ingredients are not incorporated into the composition in the correct amounts, the composition will not function in the correct manner to produce the desired amount of gas, or may even malfunction or explode.

With evidence of the above arguments and facts in our mind, we have invented a pyrotechnic composition which consists of no more than two components or ingredients. This composition functions in the precise manner to produce small aerosol particles. The small aerosol particles of this composition have physiological affects on personnel subjected to it, when the composition is ignited.

DESCRIPTION OF THE INVENTION

The composition we have invented is merely a mixture of an energetic material named 3,3-bis(aziodomethyloxetane) and a chemical called EA3834A which is a U.S.A. designation for a chemical called N-methyl-4 piperidyl isopropylphenylglycolate hydrochloride.

The mixture is a smooth burning composition that disseminates large yields of incapacitants. It is highly advantageous to U.S. military to have such a composition, in proper containment, ready for use when desired. The range of the energetic material in the composition is between 35 to 65 percent by weight with the remainder being the cited gas or vapor-producing material for a total of 100 percent by weight which represents the entire composition. If the amount of the energetic material is below 35 percent by weight, the mixture will fail to ignite due to lack of energy. On the other hand, if the amount of vapor-producing material is present below 35 percent by weight, the latter yield of gas will fall below acceptable limits. With either ingredients above 35 percent by weight, the other ingredient is present in an amount which will total 100 percent by weight in any combination for the total composition.

Experiments were carried out with an equal weight of both components of the mixture, i.e., 50 percent by weight for each ingredient. However, such mixtures, although acceptable in functions, were not the best in terms of yield of vapor or what is termed herein many times as gas.

Based on experience, the best composition contained about 40 percent by weight of the energetic material and 60 percent by weight of the gas or vapor-producing material.

The mixture has both military and law enforcement applications. This is because the mixture when ignited by standard ignition methods is an ideal system of delivering the incapacitating agent against hostile personnel.

PROCEDURE OF MAKING

The energetic material and the gas or vapor-producing material are each oven-dried at 125 degrees F. Each of the cited components are then pushed through a no. 16 sieve screen to assure particle size less than 1.19 mm in size. The two components are then mixed together, after drying, in a suitable container with a spatula until homogeneous. This mixture is now placed in standard containment vessels or standard vehicles, such as M8 grenade or a 40 mm grenade, and is ready for use when ignited.

RESULTS

The resulting mixture, when ignited, is a smooth burning pyrotechnic that can be disseminated at will, in large yields of incapacitating vapors or gas, into the atmosphere to provide a superior controlling atmosphere.

The above cool burning energetic component produces no toxic gases. The activated mixture produces particles in such ranges in size that it can be inhaled. This range is approximately 0.5 to 5 microns.

Once inhaled, the incapacitating gas or vapor physiologically acts on the intended personnel. This is usually on hostile enemy in a battlefield engagement.

The cool burning system produces high yields of small airborne particles, and advantageously there is less of a chance of starting undesired fires in enclosed areas, such as a room.

FIELD OF USE

As stated, the mixture has application in both military and law enforcement operations and may be distributed through systems, such as M651 40 mm grenade.

It will be apparent to those of ordinary skill in this art that various changes and modifications may be made therein without departing from the scope and spirit of the invention.

What is claimed is:

1. A physiologically acting mixture for use in a hostile environment being of 3,3-bis(azidomethyloxetane) which is an energizer and EA3834A, N-methyl-4 piperidyl isopropylphenylglycolate hydrochloride, which is a gas-producing agent.

2. The mixture of claim 1 in which said energizer is present in amount of between about 35 and about 65 percent by weight, and the remainder of a total weight being between about 35 and about 65 percent by weight of said gas producing agent.

3. The mixture of claim 1 in which said energizer is present in amount of about 40 percent by weight and said gas producing agent is present in the amount of about 60 percent by weight.

4. The mixture of claim 1 in which said energizer is present in amount of about 50 percent by weight and said gas producing agent is present in the amount of about 50 percent by weight.

* * * * *